US010913522B2

(12) United States Patent
Yamazaki et al.

(10) Patent No.: US 10,913,522 B2
(45) Date of Patent: Feb. 9, 2021

(54) OUTBOARD MOTOR

(71) Applicant: SUZUKI MOTOR CORPORATION, Shizuoka (JP)

(72) Inventors: Akinori Yamazaki, Shizuoka (JP); Nobuyuki Shomura, Shizuoka (JP); Seiji Uehara, Shizuoka (JP); Ryota Ariga, Shizuoka (JP)

(73) Assignee: SUZUKI MOTOR CORPORATION (JP)

( * ) Notice: Subject to any disclaimer, the term of this patent is extended or adjusted under 35 U.S.C. 154(b) by 0 days.

(21) Appl. No.: 16/579,214

(22) Filed: Sep. 23, 2019

(65) Prior Publication Data

US 2020/0156752 A1 May 21, 2020

(30) Foreign Application Priority Data

Nov. 19, 2018 (JP) ..... 2018-216222

(51) Int. Cl.
*B63H 20/32* (2006.01)
*G10K 11/162* (2006.01)

(52) U.S. Cl.
CPC ..... *B63H 20/32* (2013.01); *G10K 11/162* (2013.01)

(58) Field of Classification Search
CPC ..... B63H 20/32; B63H 21/26; B63H 21/28; B63H 21/265; G01K 11/162; G10K 11/162; F02M 35/167
See application file for complete search history.

(56) References Cited

U.S. PATENT DOCUMENTS 5,083,538 A * 1/1992 Hubbell ..... F02B 61/045 123/195 C
5,683,277 A * 11/1997 Tsunoda ..... F02F 7/006 123/195 P

FOREIGN PATENT DOCUMENTS

JP 2005076619 A 3/2005

* cited by examiner

*Primary Examiner* — Stephen P Avila
(74) *Attorney, Agent, or Firm* — Barnes & Thornburg LLP

(57) ABSTRACT

An outboard motor includes an engine cover, a throttle body, and a silencing chamber. The engine cover covers an engine and is provided with a combustion air intake port. The throttle body is connected to the engine and is configured to take in combustion air from the combustion air intake port. The silencing chamber is provided above the engine and is placed in an intake passage that guides the combustion air to the throttle body. At least one of a hole member including a plurality of holes with respective predetermined depths, and a plurality of suction pipes elongated in a front-rear direction of the outboard motor, is disposed in a position communicating with the silencing chamber.

18 Claims, 10 Drawing Sheets

OUTBOARD MOTOR

CROSS-REFERENCE TO RELATED APPLICATIONS

This application claims the benefit of priority of Japanese Patent Application No. 2018-216222, filed Nov. 19, 2018, the entire contents of which are incorporated herein by reference.

BACKGROUND OF THE INVENTION

Field of the Invention

The present invention relates to an outboard motor that guides combustion air from a combustion air intake port of an engine cover to the engine via an intake passage.

Description of the Related Art

In the case of an intake structure that directly supplies combustion air, which is taken in from a combustion air intake port of an engine cover, to a throttle body without causing the combustion air to flow through a space in the vicinity of the engine (hereinafter, the structure will be referred to as a direct intake type for convenience), intake noise is easily transmitted to outside from the engine cover.

Meanwhile, when air is taken into the throttle body from the intake port provided inside of the engine cover, it is easy to take measures against intake noise because a silencing structure can be designed with a degree of freedom in terms of space by utilizing a space between the engine cover and the engine and because a thick sound absorbing member can be pasted on the engine cover.

However, in the case of the direct intake type, a silencing device (silencing chamber) in the intake passage which connects to the throttle body is disposed at an upper portion of the engine, that is, an upper position of the engine cover because a combustion air intake port is generally located in an upper portion of the engine cover. For this reason, intake noise easily leaks to outside. It is possible to take measures such as providing a resonator with a certain capacity in the intake passage, or pasting a sound absorbing member on the engine cover. However, the upper portion of the engine cover generally has a narrower internal space as compared with a side portion and a lower portion of the engine cover, and hence, it is difficult to cope with intake noise effectively for the reasons that securing the capacity of the resonator is difficult, securing the space for pasting a sound absorbing member is difficult, and the like.

In outboard motors, a so-called large outboard motor having a high output generates large intake noise, and a single hull is often equipped with a plurality of outboard motors with large engine outputs (equipped with multiple outboard motors). Consequently, in order to improve product value, it is more important to take measures against intake noise without increasing a lateral width of the outboard motor in the case of a large outboard motor than in the case of a small outboard motor. In the meantime, a prior art aiming at a silencing effect by including a plurality of intake ducts in an air cleaner is disclosed in JP 2005-076619 A.

However, JP 2005-076619 A is an example that is applied to an automatic four-wheeled vehicle, and is described schematically. Accordingly, it is difficult to adopt the schematically described idea directly in an outboard motor which is far smaller as compared with an automatic four-wheeled vehicle, and technical efforts are required.

Further, some intake structures of outboard motors have water intrusion prevention devices that prevent intrusion of water into the intake ports connecting to the throttle bodies. As this type of water intrusion prevention device, a louver structure is simple in structure and space-saving, and thus, the adoption of the structure can be an effective method, but there is a problem that the intake noise is reflected on the louver and diffused in many directions.

SUMMARY OF THE INVENTION

The present invention has been made in consideration of the aforementioned circumstances, and it is an object of the present invention to provide an outboard motor that can effectively reduce intake noise that occurs in an intake stroke of an engine of the outboard motor.

An outboard motor according to an aspect of the present invention includes an engine cover, a throttle body, and a silencing chamber. The engine cover covers an engine and is provided with a combustion air intake port. The throttle body is connected to the engine and is configured to take in combustion air from the combustion air intake port. The silencing chamber is provided above the engine and is placed in an intake passage that guides the combustion air to the throttle body. At least one of a hole member including a plurality of holes with respective predetermined depths, and a plurality of suction pipes elongated in a front-rear direction of the outboard motor, is disposed in a position communicating with the silencing chamber.

According to an aspect of the present invention, a silencing chamber is placed in an intake passage that guides combustion air from a combustion air intake port of an engine cover to a throttle body connected to an engine, and a hole member including a plurality of holes or a plurality of suction pipes are disposed in a position communicating with the silencing chamber. Consequently, the intake noise that occurs in the intake stroke of the engine of the outboard motor can be effectively reduced by a silencing function by the silencing chamber, and a silencing function using air column resonance by at least one of the holes of the hole member and the suction pipes.

The nature and further characteristic features of the present invention will be described hereinafter in the following descriptions made with reference to the accompanying drawings, and the other advantages effects and functions of the present invention will be also made clear hereinafter.

BRIEF DESCRIPTION OF THE DRAWINGS

FIG. 3 is a perspective view illustrating an engine cover and the like in FIG. 1 by exploding the engine cover and the like.

DETAILED DESCRIPTION

Hereinafter, an embodiment for carrying out the present invention will be described based on the drawings.

Figure 1:
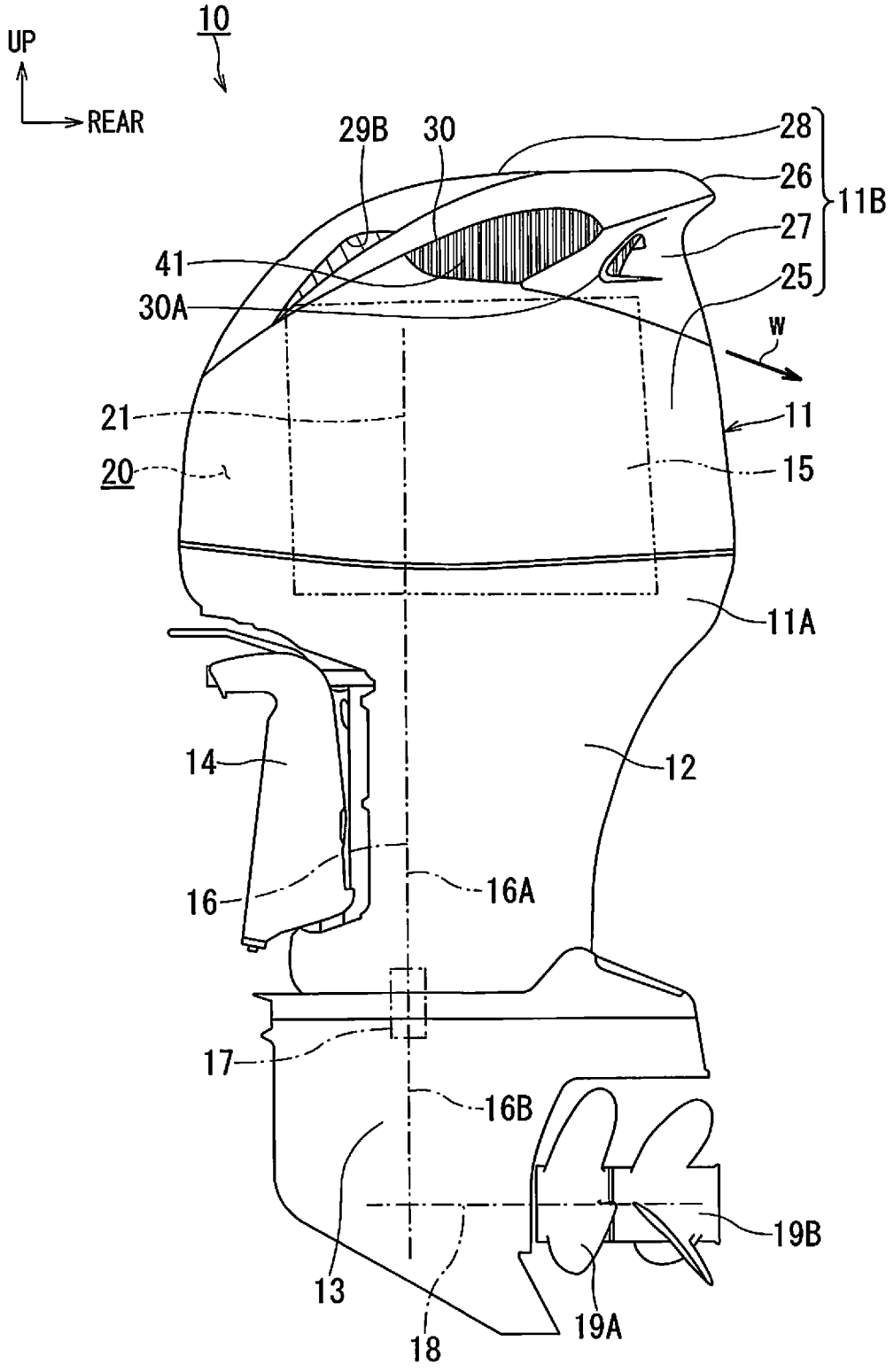
FIG. 1 is a left side view illustrating one embodiment of an outboard motor according to the present invention.

FIG. 1 is a left side view illustrating one embodiment of an outboard motor according to the present invention. Note that front, rear, left, right, up and down directions in the present embodiment refer to the directions in a state where the outboard motor is mounted to a stern of a hull, and are indicated according to necessity in the respective drawings.

A casing of an outboard motor 10 has an engine housing 11, a drive shaft housing 12 that is provided on a lower side of the engine housing 11, and a gear housing 13 that is provided on a lower side of the drive shaft housing 12. The outboard motor 10 is mounted to a stern of a hull not illustrated by using a bracket device 14 provided at a front portion of the outboard motor 10.

Figure 7:
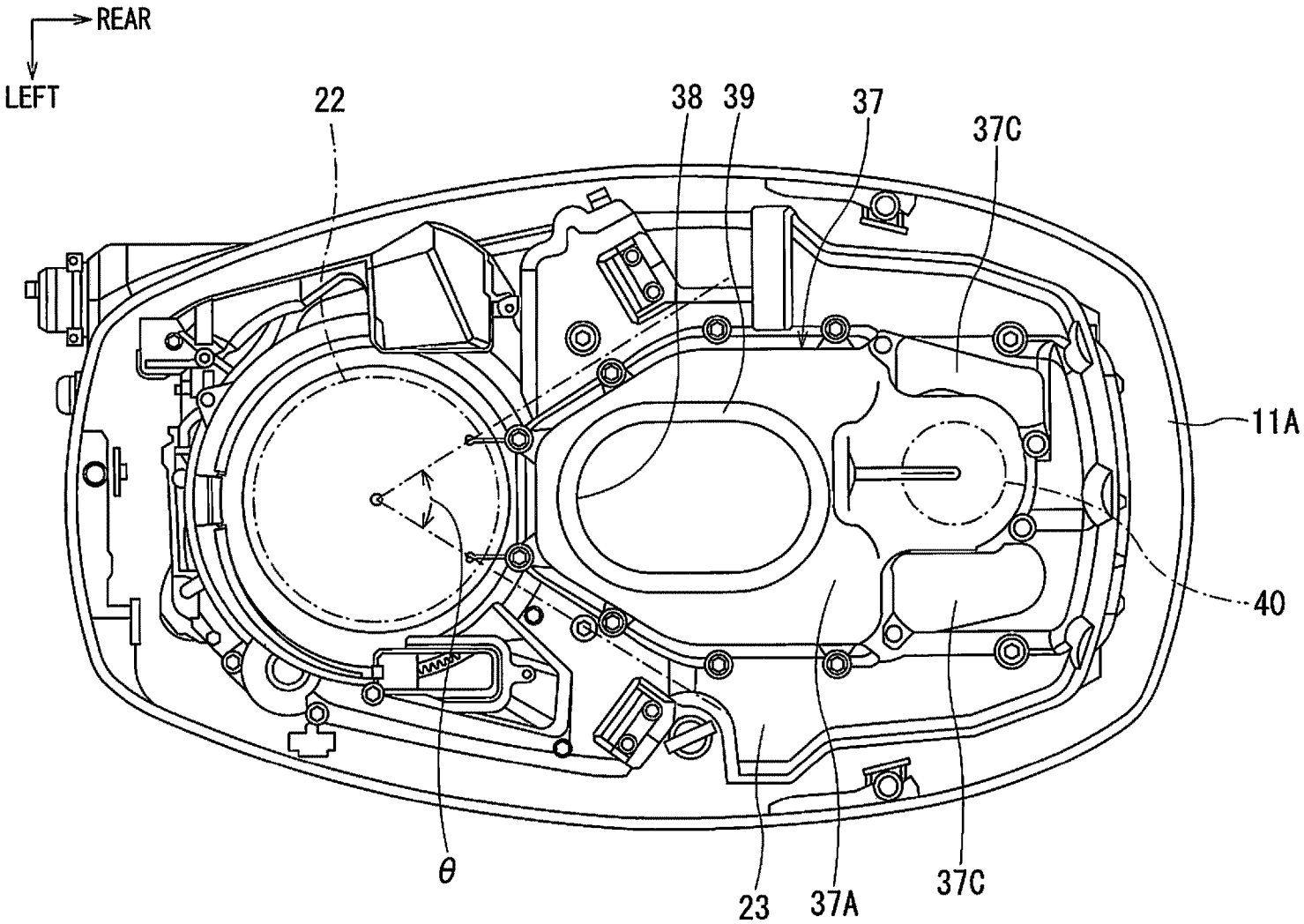
FIG. 7 is a plan view illustrating the engine, the cover, the ring gear, the silencing chamber and the like viewed from above by removing the engine cover in FIG. 1 and FIG. 2.

A drive system of the outboard motor 10 has an engine 15 that is an internal combustion engine, a drive shaft 16, a shift mechanism 17, a propeller shaft 18, and propulsive propellers 19A and 19B. The engine 15 is a drive power source of the outboard motor 10, and is housed in an engine chamber 20 in the engine housing 11. The engine 15 is a water-cooling V type engine, and is disposed in an orientation in which an axial direction of a crankshaft 21 is in a vertical direction. As shown in FIG. 7, the engine 15 is installed in such a manner that left and right cylinder sections (a cylinder block, a cylinder head) are disposed in a V-shape in plan view opening toward a rear at a V bank angle θ.

The drive shaft 16 is disposed to extend vertically in the drive shaft housing 12, and rotational driving force of the engine 15 is transmitted to the drive shaft 16. The drive shaft 16 includes a first drive shaft 16A, and a second drive shaft 16B. The shift mechanism 17 is configured to connect and disconnect transmission of the rotational driving force between the first drive shaft 16A and the second drive shaft 16B, and switch a rotational direction.

The propeller shaft 18 is disposed to elongate in the front-rear direction in the gear housing 13, and is configured to transmit the rotational driving force of the engine 15, which is transmitted to the drive shaft 16, to the propulsive propellers 19A and 19B. The propulsive propeller 19A is a front propulsive propeller, the propulsive propeller 19B is a rear propulsive propeller, and the propulsive propellers 19A and 19B form contra-rotating propellers.

Figure 2:
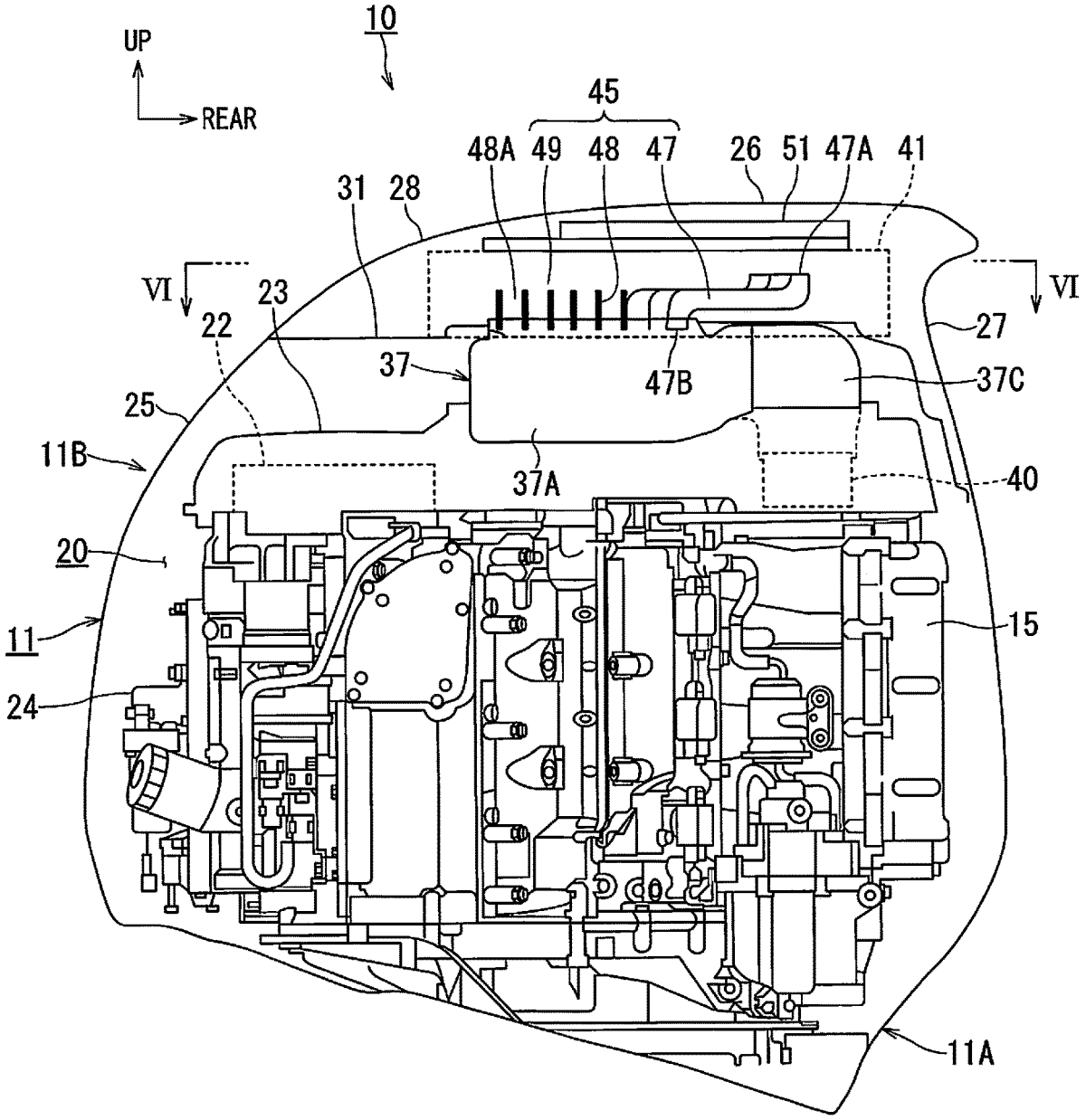
FIG. 2 is a schematic side view illustrating an engine, a silencing chamber, a lid member, a sound absorbing member and the like by breaking an engine housing in FIG. 1.

As illustrated in FIG. 2, at an upper end of the crankshaft 21 of the engine 15, a flywheel 22, and a magneto generator not illustrated that is configured integrally with the flywheel 22 are provided. The flywheel 22, the magneto generator, and a ring gear cover 23 that covers a ring gear for starter (not illustrated) are placed above the engine 15. Further, at a front portion of the engine 15, a regulator 24 configured to control a current that is generated by the magneto generator is disposed.

The engine housing 11 illustrated in FIG. 1 is configured by an under cover 11A, and an engine cover 11B as an upper cover that is detachably attached to an upper portion of the under cover 11A. The engine cover 11B covers the engine 15 as illustrated in FIGS. 1 and 2, and is configured by an engine cover main body 25, a top cover 26 and a tail cover 27 that are detachably attached to an upper portion of the engine cover main body 25, and a cover cap 28 that is detachably attached to an upper portion of the top cover 26.

On left and right side surfaces in an upper portion of the engine cover 11B, a combustion air intake port 30 are formed to open to an outer surface of the engine cover 11B. The combustion air intake port 30 presents a streamline shape which is long in a front-rear direction, with the engine cover main body 25, the top cover 26 and the tail cover 27 formed in combination in a boundary of the combustion air intake port 30. Further, in the top cover 26, sub combustion air intake port 30A is formed behind the combustion air intake port 30.

Note that in a boundary of the top cover 26 and the cover cap 28, a ventilation air exhaust port 29B is formed at a left side, and a ventilation air intake port 29A (FIG. 6) is formed at a right side respectively. The ventilation air intake port 29A and the ventilation air exhaust port 29B are for ventilation of air in the engine chamber 20.

Figure 3:
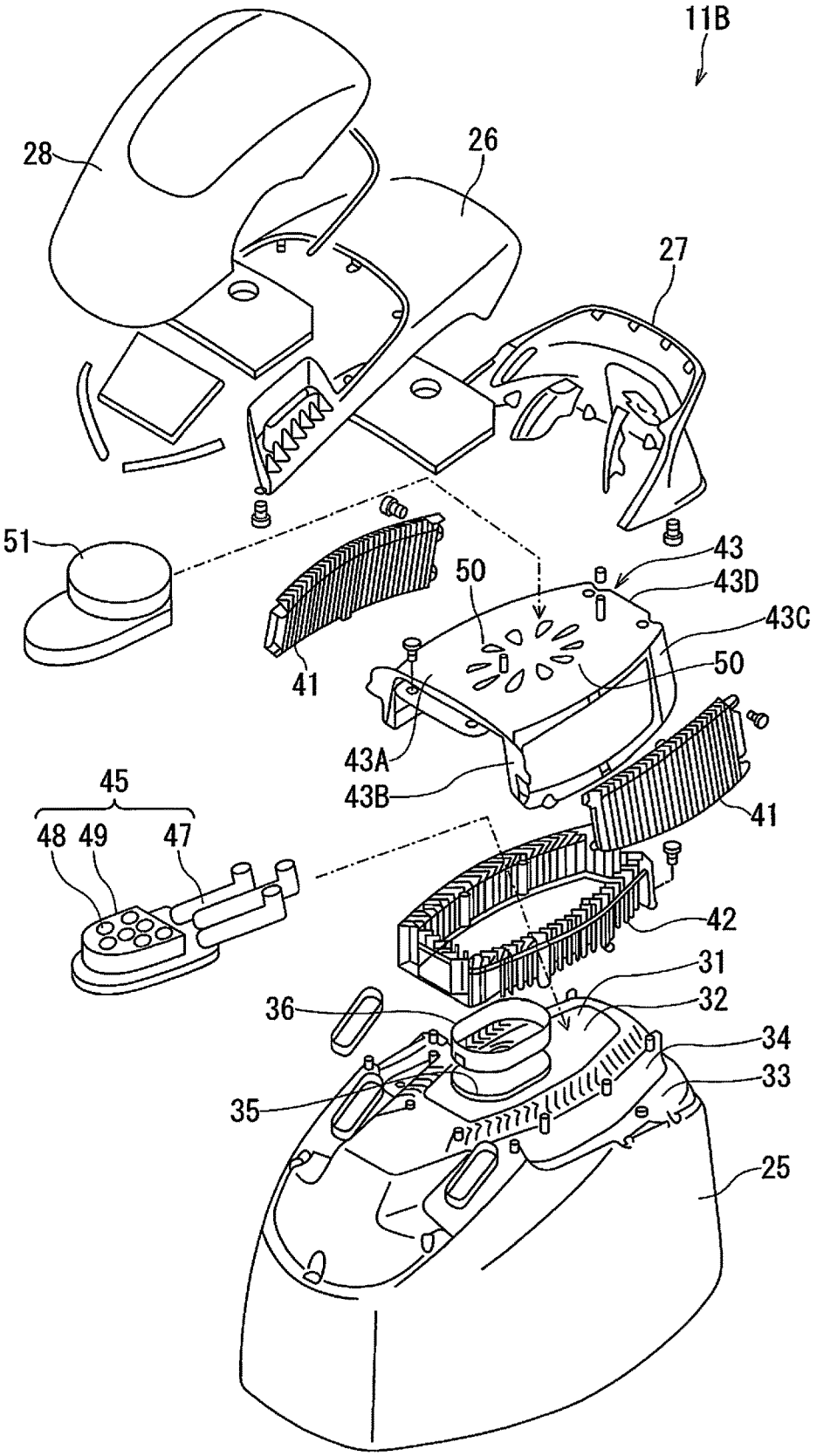

As illustrated in FIG. 3, on a ceiling surface 31 of the engine cover main body 25, a central portion 32 that bulges upward, and recessed portions 33 that are formed at left and right sides of the central portion 32 are formed. The central portion 32 and the recessed portion 33 continue to each other via an inclined surface 34 that lowers to the recessed portion 33 from the central portion 32.

An introduction hole 35 for introducing combustion air is formed in the central portion 32 of the engine cover main body 25, and a waterproof guard 36 is provided around the introduction hole 35. The introduction hole 35 communicates with a silencing chamber 37 that is installed in the ring gear cover 23 above the engine 15 illustrated in FIGS. 2 and 4. A seal member 39 is provided between a periphery of the introduction hole 35 of the engine cover main body 25 and a periphery of an intake opening 38 of the silencing chamber 37. Since the introduction hole 35 and the intake opening 38 are disposed substantially planarly, when the engine cover 11B is attached to the under cover 11A, the seal member 39 is compressed and closely contacted in a vertical direction (perpendicular direction to a plane), and the seal member 39 is easily attachable and detachable and can hold air tightness.

As illustrated in FIGS. 2, 3, 4 and 7, a throttle body 40 is disposed in a space behind the area between the left and right cylinder portions that open in a V-shape in plan view of the engine 15. The throttle body 40 is connected to the engine 15, and takes in combustion air from the combustion air intake port 30 of the engine cover 11B. In the engine chamber 20 in the engine cover 11B, an intake passage of a direct intake type that directly guides the combustion air from the combustion air intake port 30 of the engine cover 11B to the throttle body 40 without causing the combustion air to flow in the engine chamber 20 is formed above the engine 15. The intake passage is configured to have the combustion air intake port 30 of the engine cover 11B, a lid member 45 (described in detail later), the introduction hole 35 of the engine cover main body 25, the silencing chamber 37, and the ring gear cover 23.

Note that the intake passage may be of other intake types which guide the combustion air from the combustion air intake port 30 of the engine cover 11B to the throttle body 40 after causing the combustion air to flow in the engine chamber 20.

As illustrated in FIGS. 1 and 3, upper edge portions at a left and a right of the engine cover main body 25 have shapes descending backward in side view, and the recessed portions 33 are also made inclined surfaces that lower backward. Between the engine cover main body 25 and the tail cover 27, a gap is provided in a spot corresponding to a rear end of at least the recessed portion 33. Water in the recessed portion 33 is discharged to outside from the above described gap between the engine cover main body 25 and the tail cover 27 (refer to an arrow W in FIG. 1).

Here, inside of the top cover 26 and the tail cover 27, an outer louver 41 and an inner louver 42 as water separation sections are disposed. The outer louver 41 is disposed to face the combustion air intake port 30 of the engine cover 11B. The inner louver 42 is disposed to face an inner side of the outer louver 41 with a predetermined space from the inside of the outer louver 41. The combustion air that is taken in from the combustion air intake port 30 passes through the outer louver 41 and the inner louver 42, further passes through a lid member 45 that will be described later, and is supplied to the engine 15 via the silencing chamber 37, the ring gear cover 23 and the throttle body 40 from the introduction hole 35 of the engine cover main body 25.

Figure 6:
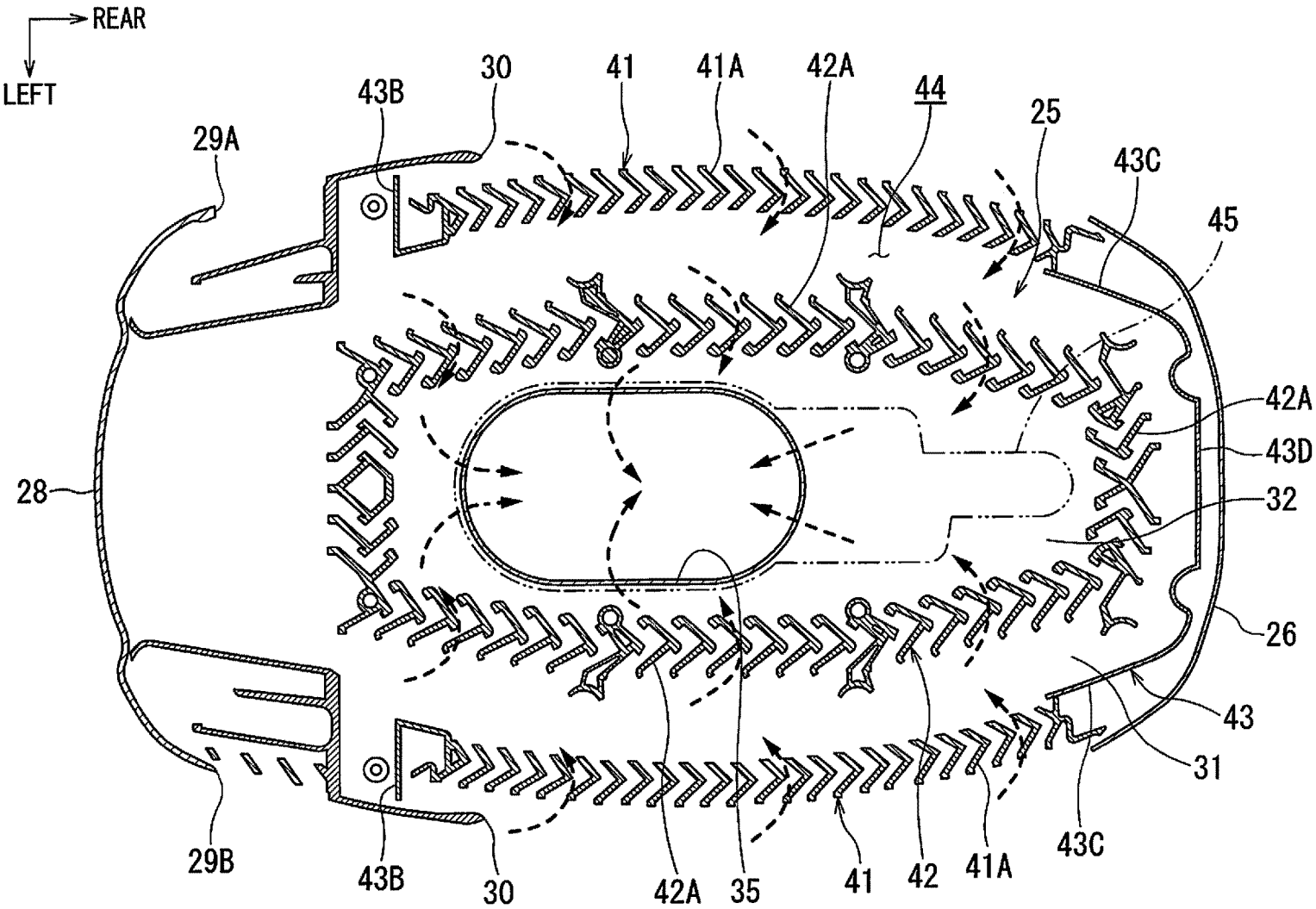
FIG. 6 is a sectional view along line VI-VI in FIG. 2.

As illustrated in FIGS. 3 and 6, the inner louver 42 is formed by arranging a plurality of blades 42A, and has a vertical louver structure with a longitudinal direction of the blades 42A in the vertical direction. The inner louver 42 is configured to form a ring shape in plan view. The inner louver 42 is placed on and fixed to the central portion 32 of the ceiling surface 31 of the engine cover main body 25 in such a manner as to surround the introduction hole 35 of the engine cover main body 25.

Figure 5:
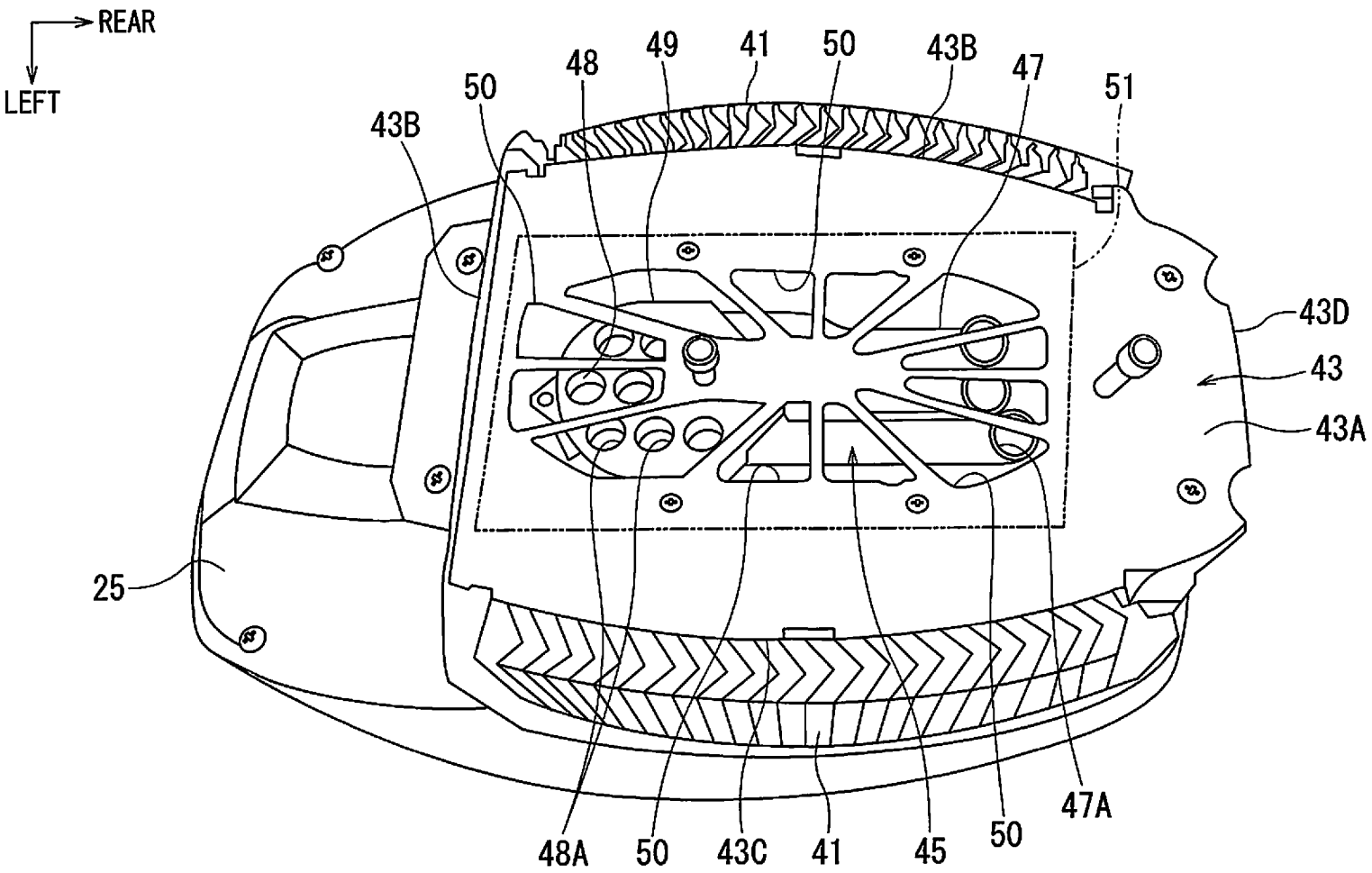
FIG. 5 is a perspective view illustrating an engine cover main body, a louver supporting frame and the like in FIG. 1 and FIG. 3.

The outer louver 41 is formed by arranging a plurality of blades 41A, and has a vertical louver structure with a longitudinal direction of the blades 41A in the vertical direction. A pair of left and right outer louvers 41 is prepared, and is respectively configured to be in curved plate shapes. As illustrated in FIGS. 3, 5 and 6, a pair of left and right outer louvers 41 is supported by a louver supporting frame 43. The louver supporting frame 43 is in a box shape having a ceiling surface 43A that closes an upper opening of the inner louver 42, a front surface 43B and left and right side surfaces 43C that are opened, and a closed rear surface 43D, and the outer louvers 41 are supported at the left and right side surfaces 43C.

The louver supporting frame 43 is fixed to the ceiling surface 31 of the engine cover main body 25 in such a manner as to cover the inner louver 42. Thereby, the left and right outer louvers 41 are disposed to face each other with a predetermined space from the left and right side surfaces of the inner louver 42. In this state, the outer louver 41 is disposed above the recessed portion 33 of the engine cover main body 25, and a gap is secured between a lower end of the outer louver 41 and the recessed portion 33 of the ceiling surface 31 of the engine cover main body 25. Further, as illustrated in FIG. 1, the outer louver 41 is installed in a position that corresponds to the combustion air intake port 30, and is a position set back from the outer surface of the engine cover 11B.

Rain and spray are mainly included in the combustion air which is taken in from the combustion air intake port 30 of the engine cover 11B when ship moves forward. As illustrated in FIG. 6, the combustion air inertially collides with the left and right outer louvers 41 and is separated into gas and liquid, and thereafter reaches a peripheral space 44 outside the inner louver 42. Of the water included in the combustion air which reaches the peripheral space 44, large water droplets drop with own weights before reaching the inner louver 42, and most of water that reaches the inner louver 42 has a fixed diameter or less.

The combustion air including the water of the fixed diameter or less inertially collides with the inner louver 42 and is separated into gas and liquid. Water droplets adhering to the blades 42A of the inner louver 42 grow on the blades 42A, flow down along the blades 42A by own weights, and are discharged to outside as shown by an arrow W in FIG. 1 with the water separated in the outer louver 41, from the recessed portion 33 (FIG. 3) of the engine cover main body 25.

Figure 4:
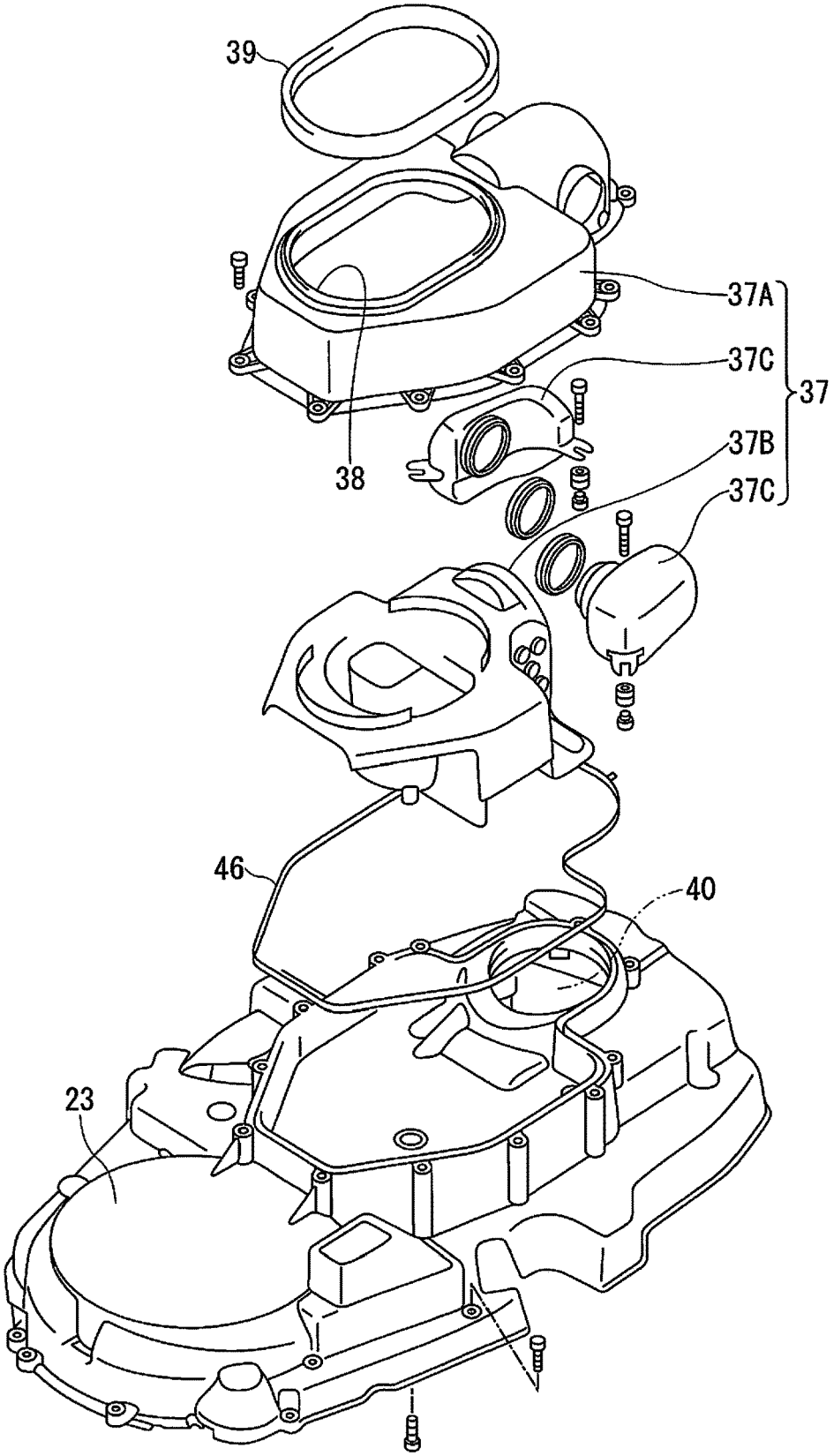
FIG. 4 is a perspective view illustrating the silencing chamber in FIG. 2, and a cover and a ring gear by exploding the silencing chamber, the cover and the ring gear.

As shown by a broken line arrow in FIG. 6, the combustion air from which water is separated in the outer louver 41 and the inner louver 42 described above flows into the silencing chamber 37 from the introduction hole 35 of the engine cover main body 25 and the intake opening 38 of the silencing chamber 37 illustrated in FIGS. 2, 4 and 7 via the lid member 45 (described later), and is introduced into the throttle body 40 via an inside of the ring gear cover 23. The combustion air which is introduced into the throttle body 40 is taken into a combustion chamber of the engine 15 in an intake stroke of the engine 15, and intake noise occurs at this time. The lid member 45, a sound absorbing member 51 and the silencing chamber 37 which will be described later effectively reduce the intake noise.

The silencing chamber 37 has a silencer cover 37A, an inner 37B, and a resonator 37C, and is configured such that the inner 37B is disposed in the silencer cover 37A, and the resonator 37C is disposed in the silencer cover 37A. The intake opening 38 is formed in a ceiling of the silencer cover 37A, and communicates with the introduction hole 35 of the engine cover main body 25 illustrated in FIGS. 3 and 6. The silencer cover 37A is fixed to the ring gear cover 23 via a seal member 46 illustrated in FIG. 4.

Figure 8:
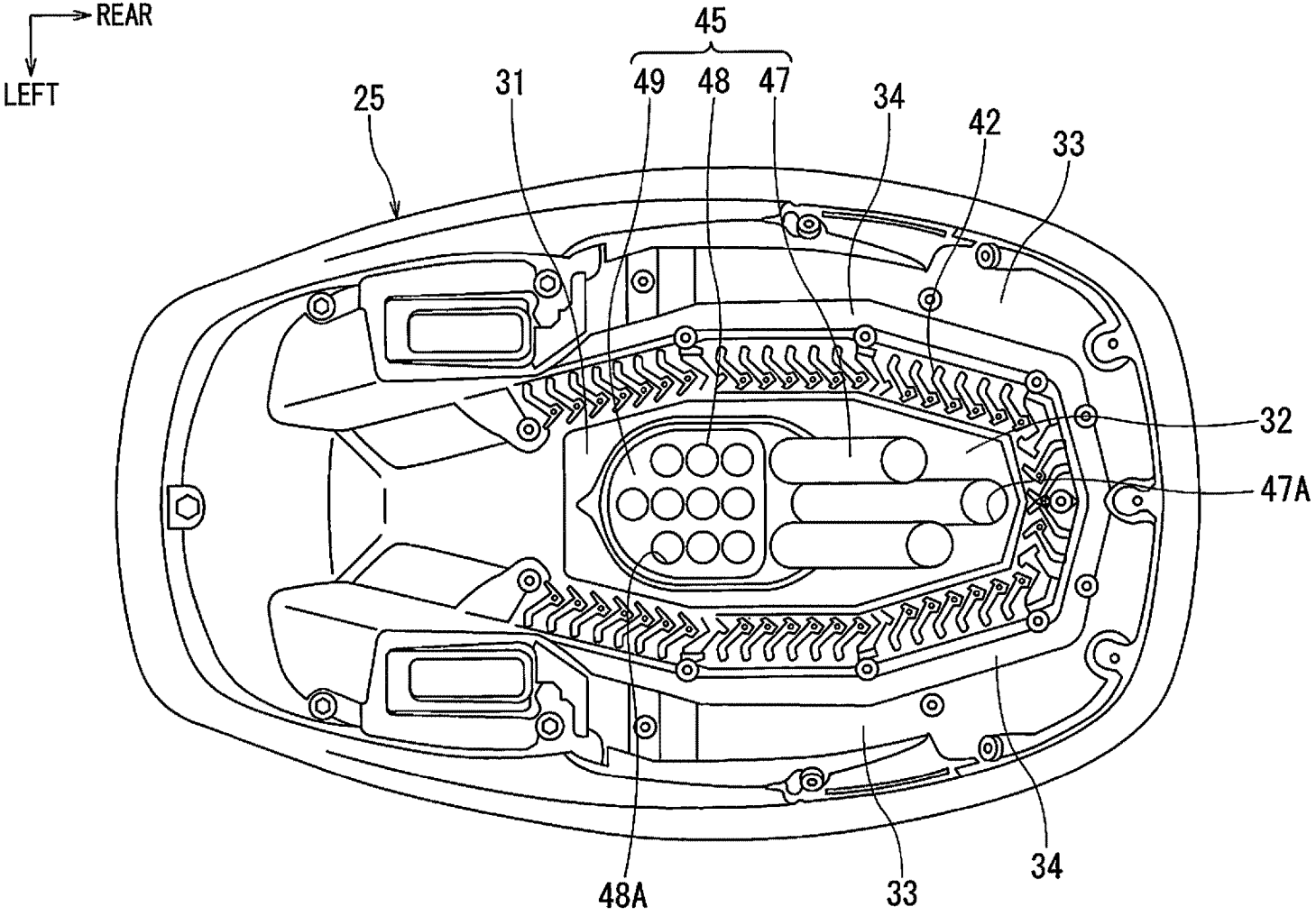
FIG. 8 is a plan view illustrating an inner louver, the lid member and the engine cover main body by removing a top cover, a cover cap, a tail cover, the louver supporting frame and an outer louver in FIG. 3.
Figure 9:
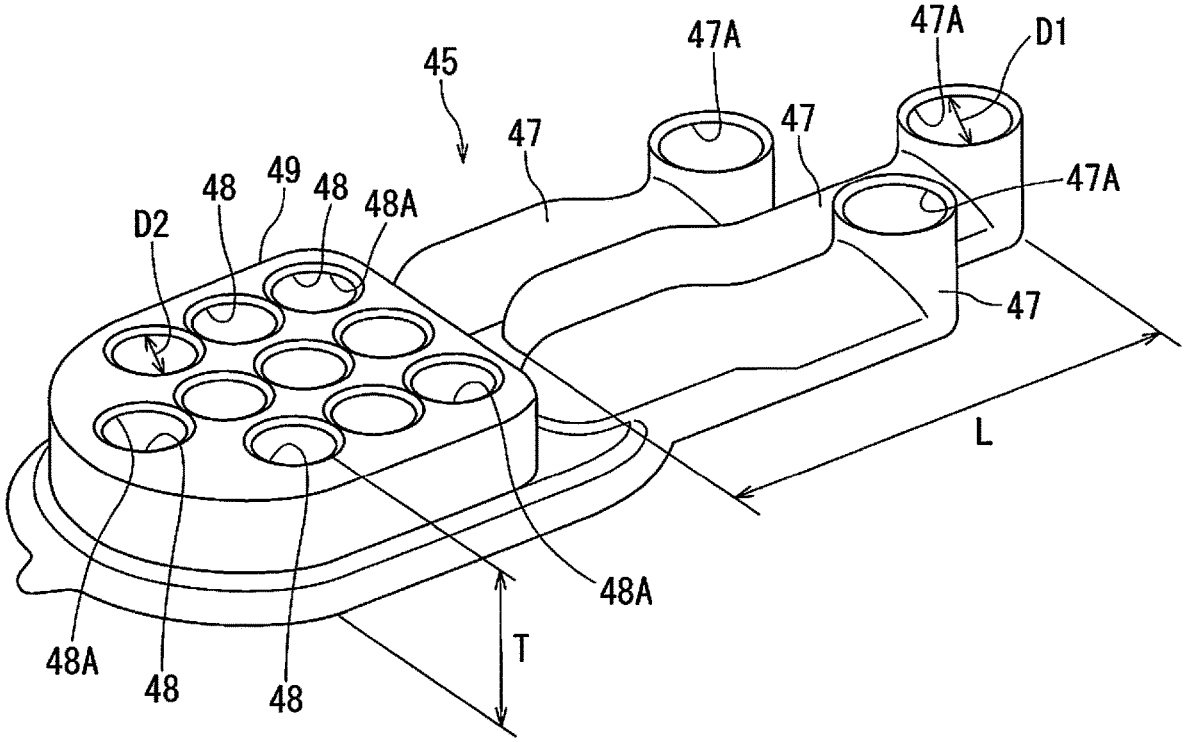
FIG. 9 is a perspective view illustrating the lid member in FIG. 8.

As illustrated in FIGS. 8 and 9, the lid member 45 is formed such that a plurality of suction pipes 47 and a hole member 49 including a plurality of holes 48 are integrally provided. As illustrated in FIGS. 2, 3 and 8, the lid member 45 is installed in the central portion 32 of the ceiling surface 31 of the engine cover main body 25. The lid member 45 covers the introduction hole 35 of the engine cover main body 25, and the intake opening 38 of the silencing chamber 37 that communicates with the introduction hole 35 in a state where the lid member 45 is installed in the ceiling surface 31 of the engine cover main body 25. At this time, lower openings 47B of the suction pipes 47, the holes 48 of the hole member 49 communicate with the introduction hole 35 and the intake opening 38.

Accordingly, intake noise that occurs in the intake stroke of the engine 15 can be reduced effectively by a silencing function of the silencing chamber 37, and a silencing function using air column resonance of both the suction pipes 47 and the holes 48 of the hole member 49 in the lid member 45. Thereby, when the hull is equipped with multiple outboard motors 10, intake noise of the respective outboard motors 10 is reduced, and ship crew is comfortable. Further, the lid member 45 is formed by only providing the hole member 49 including the holes 48 and the suction pipes 47 integrally, so that the structure is simple, and reduction in cost can be realized.

Note that in the present embodiment, the example of forming the lid member 45 by integrating the plurality of suction pipes 47 and the hole member 49 with the plurality of holes 48 is shown. However, the lid member 45 may be of a configuration in which either the plurality of suction pipes 47 or the hole member 49 with the plurality of holes 48 are provided. In the case of the configuration like this, silencing performance tends to be lower as compared with the lid member which is configured by both the plurality of suction pipes 47 and the hole member 49 with the plurality of holes 48. However, depending on the target silencing reduction performance, it is also possible to select the configuration in which at least one of the plurality of suction pipes 47, and the hole member 49 with the plurality of holes 48 is provided.

As illustrated in FIG. 8, the suction pipes 47 are provided to be elongated in the front-rear direction of the outboard motor 10, in a state where the lid member 45 is disposed on the ceiling surface 31 of the engine cover main body 25. Further, the lid member 45 is disposed inside the V bank angle θ of the V type engine 15 illustrated in FIG. 7, and is disposed in a narrow region surrounded by the inner louver 42 as illustrated in FIG. 8, in the state where the lid member 45 is installed on the ceiling surface 31 of the engine cover main body 25. Therefore, the outboard motor 10 including the lid member 45 can be made at a level of modification of an existing outboard motor structure, and can be adopted in outboard motors for existing sales with a simple assembling work. Further, since the lid member 45 is disposed in the region surrounded by the inner louver 42, water can be prevented from entering the suction pipes 47 and the holes 48 of the lid member 45.

Figure 10A:
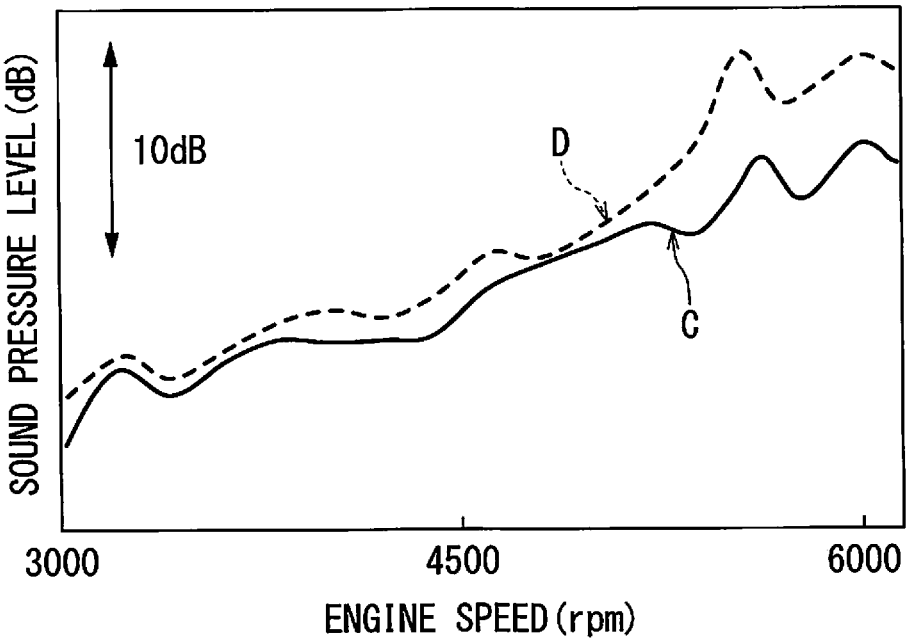
FIG. 10A is a graph illustrating a relationship between a sound pressure level of intake noise and an engine speed.
Figure 10B:
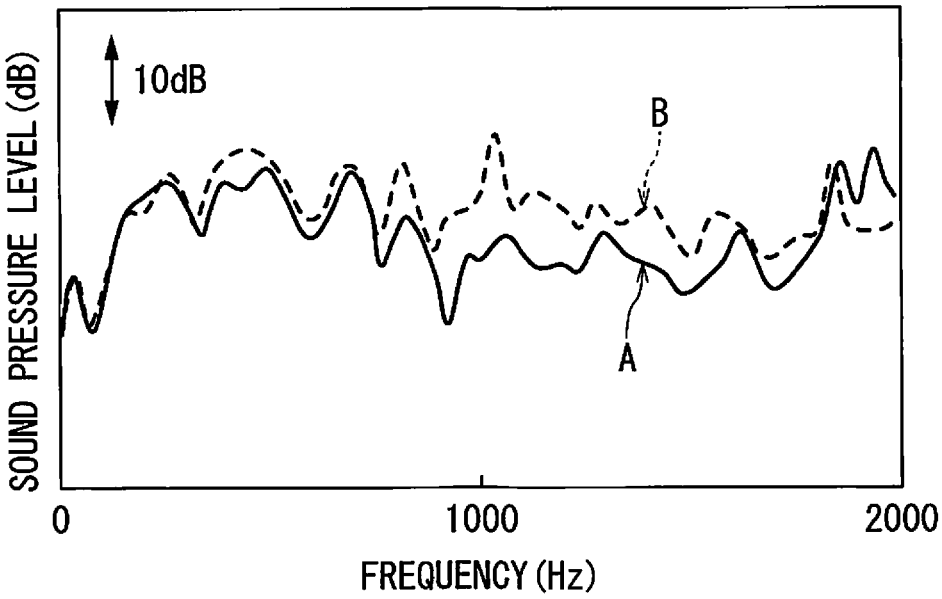
FIG. 10B is a graph illustrating a relationship between the sound pressure level and a frequency of intake noise.

Specifications of the suction pipe 47 and the hole 48 of the hole member 49 in the lid member 45 are determined to be able to mainly reduce intake noise in a high frequency range which ship crew feels uncomfortable, in particular, in a frequency range of 800 to 1000 Hz illustrated in FIG. 10B, in the present embodiment, for example. Here, the specifications of the suction pipe 47 and the hole 48 of the hole member 49 are a pipe length L of the suction pipe 47 and a depth T of the hole 48 illustrated in FIG. 9, or an opening area (for example, an inside diameter D1) of the suction pipe 47 and an opening area (for example, an inside diameter D2) of the hole 48. Further, in FIG. 10B, a curve A shows a case of the outboard motor 10 of the present embodiment, and a curve B shows a case of a conventional outboard motor in which the lid member 45 and the sound absorbing member 51 described later are not present.

In this way, by determining the specifications of the suction pipe 47 and the hole 48 of the hole member 49, a silencing effect of intake noise is exhibited in a high rotation range (high rotation range of 4000 rpm or more, for example) of the engine 15 illustrated in FIG. 10A, by the silencing function using air column resonance of both the suction pipes 47 and the holes 48. Here, in FIG. 10A, a curve C shows the case of the outboard motor 10 of the present embodiment, and a curve D shows the case of the conventional outboard motor in which the lid member 45 and the sound absorbing member 51 described later are not present.

Further, at least one of the pipe lengths L of the plurality of suction pipes 47 and the depths T of the plurality of holes 48 of the hole member 49 may be set to differ from one another. Alternatively, at least one of the opening areas (the inside diameters D1, for example) of the plurality of suction pipes 47 and the opening areas (the inside diameters D2, for example) of the plurality of holes 48 may be set to differ from one another. For example, by setting the pipe lengths L of the plurality of suction pipes 47 to differ from one another, it is also possible to change an attenuation frequency of sound of each of the suction pipes 47. As a result, it is possible to enhance the silencing performance in a broader rotation range of the engine 15, instead of enhancing the silencing performance in the specific rotation range of the engine 15.

As illustrated in FIGS. 3 and 5, frame openings 50 are formed in a ceiling surface 43A of the louver supporting frame 43 that supports the outer louvers 41, and the sound absorbing member 51 is disposed on the ceiling surface 43A in such a manner as to cover the frame openings 50. The sound absorbing member 51 can further reduce intake noise. The sound absorbing member 51 is configured by wrapping a sound absorbing member with unwoven fabric or the like, for example, and may include a water proof function by applying water-repellent treatment to the unwoven fabric or the like.

The above described sound absorbing member 51 is positioned to face to upper openings 47A of the suction pipes 47, and upper openings 48A of the holes 48 of the hole member 49 in the lid member 45 disposed under the louver supporting frame 43 at a short distance. Thereby, sound waves from the upper openings 47A of the suction pipes 47 and the upper openings 48A of the holes 48 can enter the sound absorbing member 51 substantially perpendicularly, so that the silencing effect is enhanced. Consequently, as compared with a case where the sound absorbing member 51 is simply disposed to the lid member 45 at a short distance, an intake noise reduction effect can be enhanced more.

While the embodiment of the present invention is described thus far, the embodiment is presented as an example, and does not intend to limit the scope of the invention. It is possible to carry out the embodiment in various other modes, various omissions, replacements and changes can be made within the range without departing from the gist of the invention, and the replacements and changes are included in the scope and gist of the invention, and are included in the invention according to the accompanying claims and their equivalents.

The invention claimed is:

1. An outboard motor comprising:

an engine cover that covers an engine and is provided with a combustion air intake port;

a throttle body connected to the engine and configured to take in combustion air from the combustion air intake port; and a silencing chamber provided above the engine and placed in an intake passage that guides the combustion air to the throttle body, wherein at least one of a hole member including a plurality of holes with respective predetermined depths, and a plurality of suction pipes elongated in a front-rear direction of the outboard motor is disposed in a position communicating with the silencing chamber, and wherein specifications of the plurality of holes of the hole member and specifications of the plurality of suction pipes are set to exhibit a silencing effect in a high rotation range of the engine.

2. The outboard motor according to claim 1, further comprising a sound absorbing member disposed in a position facing to openings of the suction pipes or openings of the holes of the hole member at a short distance.

3. The outboard motor according to claim 1, wherein the engine is a V type engine, and the plurality of suction pipes or the hole member including the plurality of holes is disposed in a V bank angle of the V type engine in plan view of the outboard motor.

4. The outboard motor according to claim 1, further comprising a water separation section that surrounds the plurality of suction pipes or the hole member including the plurality of holes, and separates water from the combustion air taken in from the combustion air intake port of the engine cover.

5. The outboard motor according to claim 4, wherein the water separation section has a louver structure.

6. The outboard motor according to claim 1, further comprising a resonator disposed in the silencing chamber.

7. The outboard motor according to claim 1, wherein at least one of the predetermined depths of the respective holes of the hole member and lengths of the respective suction pipes are set to differ from one another.

8. The outboard motor according to claim 1, wherein at least one of opening areas of the respective holes of the hole member and opening areas of the respective suction pipes are set to differ from one another.

9. The outboard motor according to claim 1, further comprising a lid member covering an intake opening of the silencing chamber, wherein the plurality of suction pipes and the hole member including the plurality of holes are provided in the lid member.

10. An outboard motor comprising:

an engine cover that covers an engine and is provided with a combustion air intake port;

a throttle body connected to the engine and configured to take in combustion air from the combustion air intake port;

a silencing chamber provided above the engine and placed in an intake passage that guides the combustion air to the throttle body; and a lid member covering an intake opening of the silencing chamber, wherein at least one of a hole member including a plurality of holes with respective predetermined depths, and a plurality of suction pipes elongated in a front-rear direction of the outboard motor is disposed in a position communicating with the silencing chamber, and wherein the plurality of suction pipes and the hole member including the plurality of holes are provided in the lid member.

11. The outboard motor according to claim 10, further comprising a sound absorbing member disposed in a position facing to openings of the suction pipes or openings of the holes of the hole member at a short distance.

12. The outboard motor according to claim 10, wherein the engine is a V type engine, and the plurality of suction pipes or the hole member including the plurality of holes is disposed in a V bank angle of the V type engine in plan view of the outboard motor.

13. The outboard motor according to claim 10, further comprising a water separation section that surrounds the plurality of suction pipes or the hole member including the plurality of holes, and separates water from the combustion air taken in from the combustion air intake port of the engine cover.

14. The outboard motor according to claim 13, wherein the water separation section has a louver structure.

15. The outboard motor according to claim 10, further comprising a resonator disposed in the silencing chamber.

16. The outboard motor according to claim 10, wherein specifications of the plurality of holes of the hole member and specifications of the plurality of suction pipes are set to exhibit a silencing effect in a high rotation range of the engine.

17. The outboard motor according to claim 10, wherein at least one of the predetermined depths of the respective holes of the hole member and lengths of the respective suction pipes are set to differ from one another.

18. The outboard motor according to claim 10, wherein at least one of opening areas of the respective holes of the hole member and opening areas of the respective suction pipes are set to differ from one another.

* * * * *